United States Patent [19]

Blackwood

[11] 4,038,948

[45] Aug. 2, 1977

[54] ROTARY INTERNAL COMBUSTION ENGINE

[76] Inventor: William A. Blackwood, 295 Polaris Ave., Mountain View, Calif. 94040

[21] Appl. No.: 589,017

[22] Filed: June 23, 1975

Related U.S. Application Data

[63] Continuation of Ser. No. 388,985, Aug. 16, 1973, Pat. No. 3,927,647.

[51] Int. Cl.[2] ..... F02B 57/00; F02B 57/04

[52] U.S. Cl. ..... 123/43 C; 123/44 C; 123/44 D

[58] Field of Search ..... 123/43 C, 44 C, 44 D, 123/44 E; 60/280, 605

[56] References Cited

U.S. PATENT DOCUMENTS

| | | | |
|---|---|---|---|
| 847,489 | 3/1907 | Millar | 123/43 C |
| 1,400,255 | 12/1921 | Anderson | 123/43 C |
| 1,437,928 | 12/1922 | Brockway | 123/44 C |
| 1,943,937 | 1/1934 | Gustafson | 123/43 C |
| 2,583,651 | 1/1952 | Horning | 60/280 |
| 2,920,611 | 1/1960 | Casini | 123/44 E |
| 3,161,183 | 12/1964 | Leath | 123/43 C |
| 3,517,651 | 6/1970 | Graybill | 123/44 C |
| 3,788,286 | 1/1974 | Brewer | 123/43 C |
| 3,927,647 | 12/1975 | Blackwood | 123/43 C |

FOREIGN PATENT DOCUMENTS

| | | | |
|---|---|---|---|
| 202,857 | 10/1908 | Germany | 123/43 C |

*Primary Examiner*—John J. Vrablik
*Attorney, Agent, or Firm*—Schapp and Hatch

[57] ABSTRACT

A rotary engine for two cycle operation having arcuate combustion chambers formed in a rotor and correspondingly arcuate pistons mounted for swinging reciprocation in the combustion chambers on connecting rods pivoted to the rotor. The housing contains the rotor and provides an oblong inner periphery forming a raceway for cam followers mounted on the pistons so that, when ignition of the fuel mixture occurs at the beginning of a power stroke, the pistons are forced outwardly against the relative incline of the raceway in such a manner as to cause the pistons to impart rotary motion to the rotor. At about the end of the power stroke, the movement of the rotor causes recesses formed in the rotor at the inner end of the combustion chamber to communicate with exhaust and intake ports formed in the housing on opposite sides of the rotor for venting the spent gases through one of the recesses and receiving a fresh charge of fuel mixture under pressure through the other recess in a scavenging fashion. The momentum of the rotor tends to cause it to rotate through the compression cycle wherein the cam followers riding on the raceway force the pistons into the combustion chambers to compress the air-gas mixture for ignition at approximately the innermost retracted position and thus initiate the next power stroke.

9 Claims, 9 Drawing Figures

ROTARY INTERNAL COMBUSTION ENGINE

This is a Continuation, of Application Serial No. 388,985 filed Aug. 16, 1973, now U.S. Pat. No. 3,927,647.

BACKGROUND OF THE INVENTION

The present invention relaes to a ROTARY ENGINE and more particularly to a two cycle internal combustion rotary engine with pivotally swingable pistons.

Prior art internal combustion engines typically have a plurality of pistons each mounted in a separate cylindrical combustion chamber in parallel alignment. Each piston has a separate piston rod connected thereto and the piston rods are connected through a crankshaft and train of gears to impact rotational energy. These devices generate a substantial amount of friction and consume excessive power for various other reasons.

Rotary engines have been therefore relied upon to reduce friction and thereby increase efficiency. They can be made lightweight and compact and have desirable power-to-weight ratios. Furthermore, they are characteristically simple to cast and fabricate.

Rotary engines have been developed which act against a single cam track to convert lineal reciprocating motion of pistons mounted in combustion chambers formed on a rotor to rotary motion of the rotor. U.S. Pat. No. 2,439,150 to Smith is typical of such devices. The combustion chambers and pistons in these engines are uniformly cylindrical in shape. As the rotor rotates, the reciprocal movement of the piston and connecting piston rod imparts an undesirable lateral cocking moment on the piston sliding against the cylindrical wall as the followers move on the relative incline of the cam surface. This moment causes unbalanced stresses between the piston and cylindrical chamber wall and increases friction between them. This friction results in a reduction in efficiency of the engine and excessive stress and wear on the materials of the piston and cylinder wall.

SUMMARY OF THE INVENTION

The general purpose of the present invention is to provide an improved rotary engine in which the rotor is mounted in a housing providing a cam surface having an oblong or generally elliptical inner periphery. The engine has arcuate combustion chambers formed in the rotor and arcuate pistons each mounted for swinging reciprocation in one of the chambers on a connecting rod pivoted to the rotor. Each piston is formed in mating configuration with the associated combustion chamber. The arcuate shape of the pistons and combustion chambers and the pivoted connecting rods eliminates the lateral bending and torque forces inherent in prior rotary engines having cylindrical pistons and combustion chambers. These factors further reduce the friction between the pistons and combustion chambers to thereby increase efficiency.

Cam rollers or followers are mounted on each piston so that when a piston is retracted inwardly at the beginning of a power stroke, as ignition of the fuel mixture occurs in the associated combustion chamber, the piston is forced outwardly against the oblong cam surface to cause the piston to impart rotary motion to the rotor. The piston is also urged outwardly by centrifugal force as the rotor rotates during the power stroke.

Each combustion chamber has its end relieved to form a pair of recesses separated by a protuberance. Approximately at the end of the power stroke, the combustion chamber communicates with exhaust and intake ports formed in the housing sidewalls on opposite sides of the rotor to exhaust the spent gases through one of the recesses and receive a charge of the fuel mixture into the chamber through the other recess, in a scavenging fashion. The exhaust port is positioned so that it comes into communication with the combustion chamber slightly before the intake port for improved scavenging. The cam surface is formed to accommodate the burn characteristics of the particular fuel mixture.

The angular momentum of the rotor tends to cause it to continue to rotate through the compression cycle. In this cycle, each cam follower being mounted on a piston head travels up the relative incline of the cam surface and forces the piston to swing into the inward retracted position, compressing the fuel mixture. Ignition occurs when the piston is at approximately the innermost retracted, position, beginning the power stroke once more. The rotation of the rotor at the beginning of the power stroke has been augmented by centripetal force due to the radially inward retraction of the pistons into the combustion chambers at the end of the compression stroke.

In one form, the engine is cooled by air cooling fins mounted on the rotor. The air passed through the air cooling fins as well as blowby and exhaust gases may be vented to an afterburner which burns this mixture of gases. The burnt gases may be used to drive a turbine to impart rotational energy to a blower to blow air onto the fins.

Accordingly, an object of the present invention is to provide a rotary engine with pivotally swingable pistons.

Another object of the present invention is to provide rotary engine means having at least one arcuate combustion chamber and at least one arcuate piston formed in mating configuration.

A further object of the present invention is to provide a housing for a rotary engine having an elliptical or oblong inner periphery providing a cam surface shaped for accommodating the burn characteristics of an air-gas fuel mixture ignited in the combustion chambers.

Still another object of the present invention is to provide an intake and an exhaust port each positioned on sealing plates on opposite sides of a rotary engine and aligned slightly askew relative to each other for improved scavenging.

Yet another object of the present invention is the provision of a pair of recesses separated by a wall in a combustion chamber of a rotary engine for communicating with exhaust and intake ports for improved scavenging.

An additional object of the present invention is to provide fins mounted on the periphery of a rotary engine for cooling thereof.

Further objects and advantages of the present invention will become apparent as the specification proceeds, and the new useful features will be fully defined in the claims appended hereto.

BRIEF DESCRIPTION OF THE DRAWINGS

The preferred form of the present invention is illustrated in the accompanying drawings, in which.

DESCRIPTION OF THE PREFERRED EMBODIMENT

Figure 1:
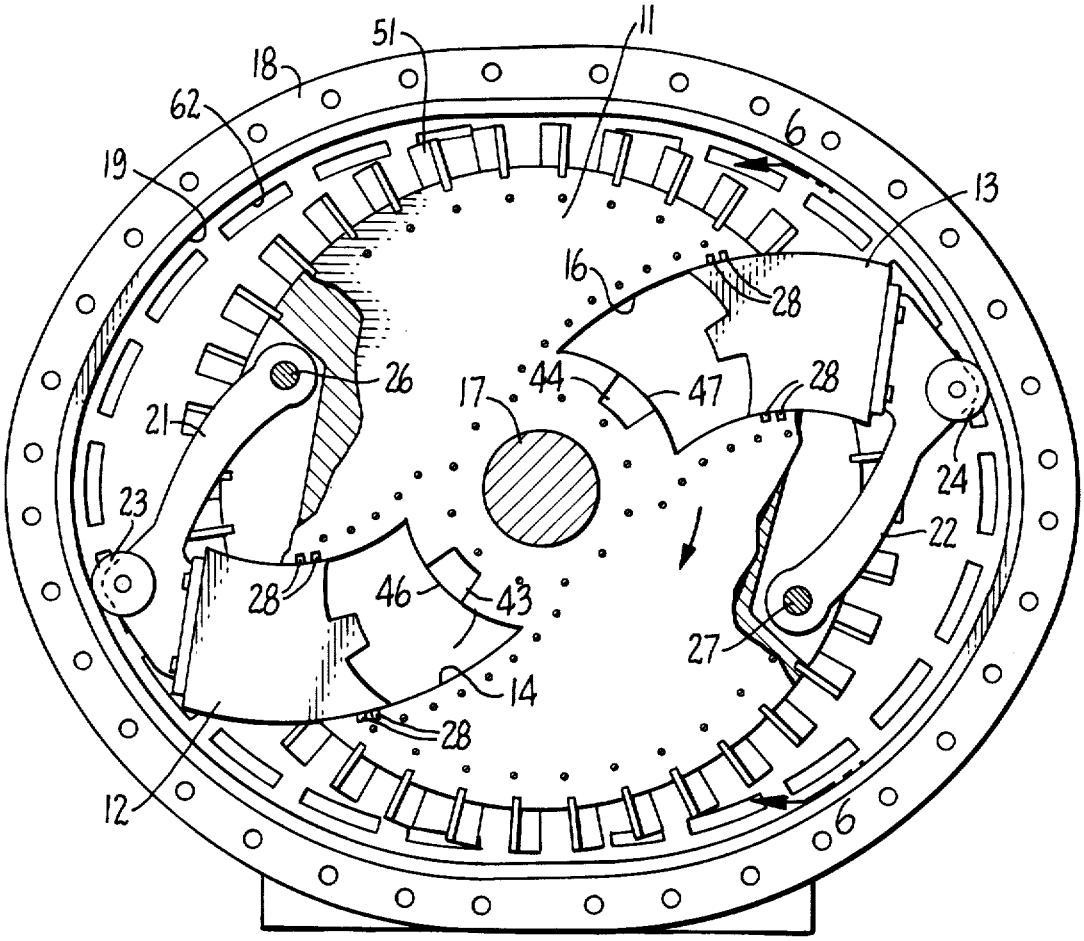
FIG. 1, is a side elevational view of a rotary engine constructed in accordance with the present invention, with portions removed to show internal mechanism.
Figure 8:
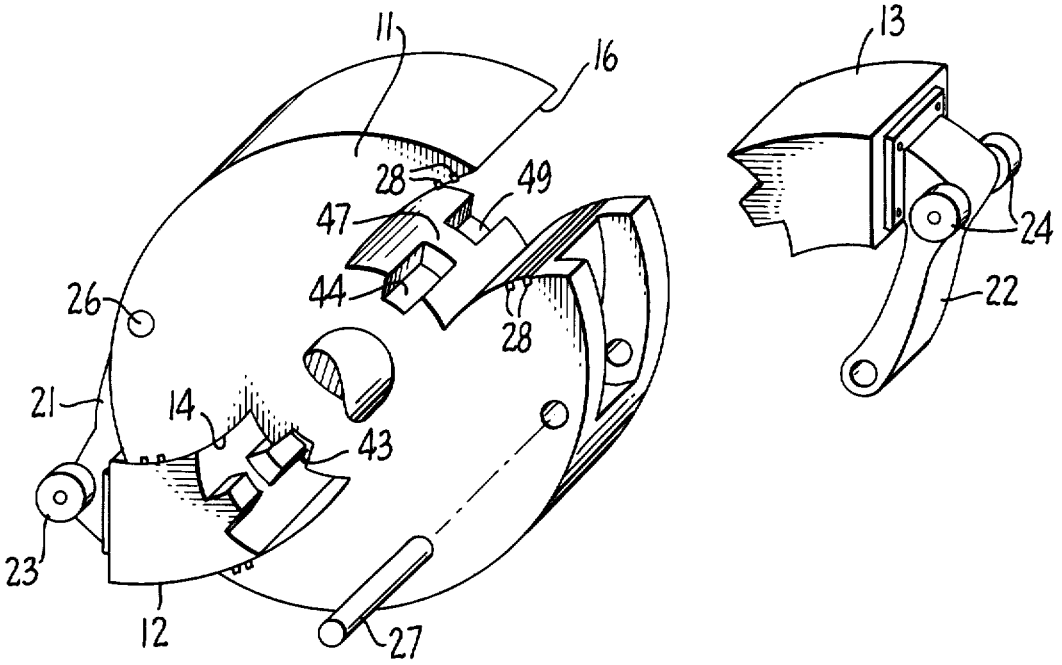
FIG. 8, is a partially exploded perspective view of the rotor and pistons of the rotary engine of the present invention.

Referring to FIG. 1, there is shown a rotor 11 having arcuate pistons 12 and 13 mounted thereon for reciprocal curvilinear movement in arcuate combustion chambers 14 and 16 respectively. The rotor is mounted on a central drive shaft 17 for transmitting rotational energy from the movement of the rotor 11 to a load. The rotor and piston assembly is mounted in a housing 18 having an oblong or elliptical inner peripheral surface 19. The pistons 12 and 13 are connected to connecting rods 21 and 22 respectively, and the connecting rod and piston assemblies have rollers 23 and 24 respectively formed for following the contour of the cam surface or raceway provided by inner periphery 19. The profile of the cam surface 19 may be modified to accommodate the burn characteristics of the particular fuel mixture being used. The connecting rods 21 and 22 are journalled for swinging movement on pivot pins 26 and 27, respectively, carried by rotor 11 shown in FIG. 8.

Figure 4:
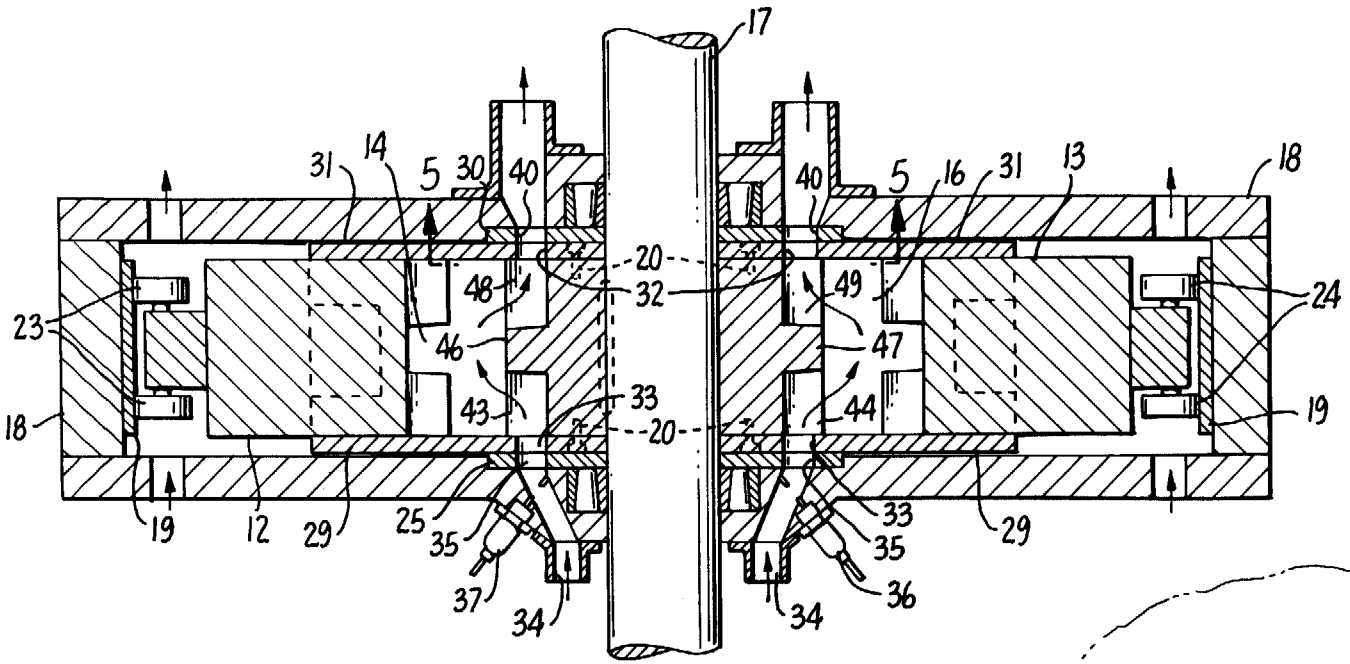
FIG. 4, is a cross-sectional view taken along the plane of line 4—4 of FIG. 2.
Figure 5:
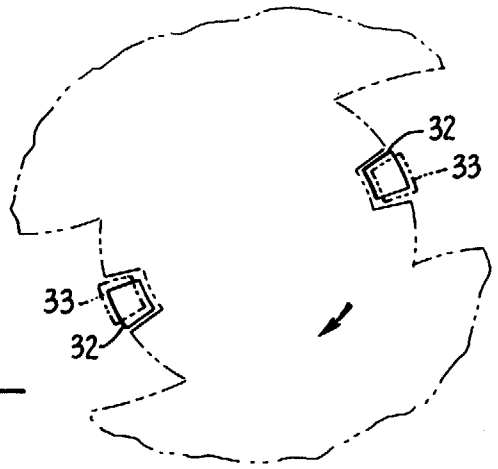
FIG. 5, is a cross-sectional view taken along the plane of line 5—5 of FIG. 4.

The arcuate combustion chambers 14 and 16 have seals 28 as shown for slidably sealing the pistons 12 and 13 in the chambers. The combustion chambers are further sealed on the sides by end plates 29 and 31 each secured on opposite sides of the rotor 11 by screws 20 as shown in FIG. 4. Side plates 25 and 30 are stationary with the housing and reduce the tolerances between the end plates and the housing. The side plates 25 and 30 have ports 35 and 40 respectively formed thereon. The end plate 29 has intake ports 33 as shown in dotted lines in FIG. 5 and the end plate 31 has exhaust ports 32 shown in solid lines in FIG. 5. The exhaust ports 32 are slightly misaligned from the intake ports 33 on the opposite faces to permit a combustion chamber to communicate with the exhaust ports slightly before communication with the intake ports. This permits the venting of the exhaust gas out of the combustion chamber to begin slightly before the beginning of the injection of the fresh fuel mixture through the intake port and into the chamber to improve scavenging.

Figure 7:
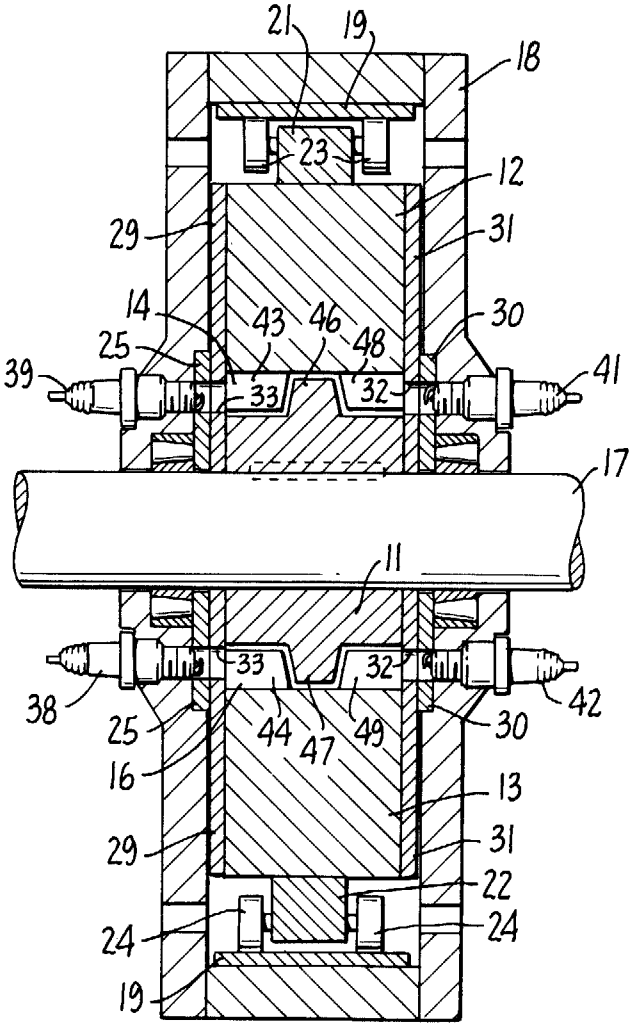
FIG. 7, is a cross-sectional view taken along the plane of line 7—7 of FIG. 3.

As shown in FIGS. 4 and 7, the interior end of the combustion chamber 14 is relieved to provide an intake recess 43 and an exhaust recess 48 separated by a protuberance 46. Similarly, the interior end of the combustion chamber 16 is also relieved to provide an intake recess 44 and an exhaust recess 49 separated by a protuberance 47. As shown in FIG. the head of each of the pistons 12 and 13 is formed in mating configuration with the associated ends of the combustion chambers 14 and 16 to accommodate the described recesses and protuberances.

Figure 2:
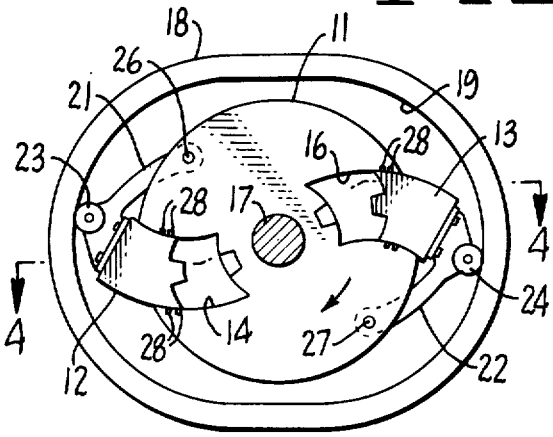
FIG. 2, is a side elevational view on a reduced scale of the engine of FIG. 1 at a different point in its operating cycle.

As may best be seen in FIG. 4, air is here injected under pressure through passage 34 and fuel is introduced through fuel injectors 36 and 37 to form a fuel mixture which is forced into the combustion chambers through ports 35 in side plate 25, intake ports 33 and recesses 43 and 44. The fuel mixture in the combustion chambers is compressed during the compression stroke of the pistons which begins approximately when the pistons are at their outermost position as shown in FIG. 2. As the rotor rotates in the clockwise direction, the fuel mixture is compressed by the forcing inwardly of the pistons 12 and 13 into combustion chambers 14 and 16 respectively as the rollers 23 and 24 are deflected inwardly by cam surface 19. The retraction of the pistons toward the center of gravity of the rotor during the compression stroke generates a centripetal force to enhance the rotation of the rotor 11.

Figure 3:
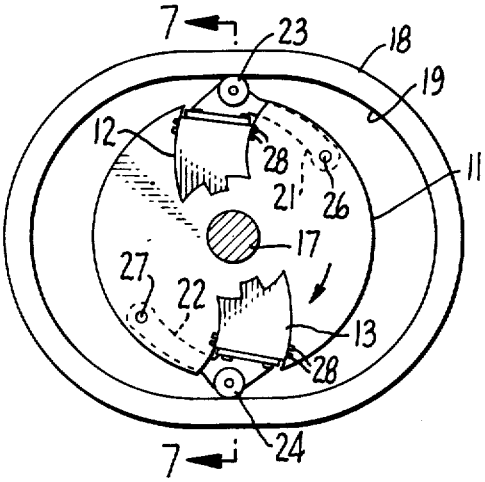
FIG. 3, is a view similar to that of FIG. 2 but at another point in its operating cycle.

When the pistons are approximately at their completely retracted position, as shown in FIG. 3, the power stroke is begun through ignition of the compressed mixture of air and fuel by spark plugs 38, 39, 41 and 42 as shown in FIG. 7. The ignition and combustion of the compressed fuel-air mixture causes pressure to be exerted against the pistons 12 and 13 to urge them outwardly. The rollers 23 and 24 mounted on pistons 12 and 13 respectively follow the cam surface 19 from the short diagonal at about the beginning of the power stroke, shown in FIG. 3, to the points on the profile surface intersecting the long diagonal. The centrifugal force urging the pistons outwardly as well as the inertia of the rotor 11 and the shaft 17, causes the rotor and shaft to rotate through the next compression stroke to thereby begin the venting of the exhaust gas through recesses 48 and 49, exhaust ports 32 and ports 40 on side plate 30. Shortly thereafter, the venting of an air-gas mixture is begun through intake ports 33 to begin the compression stroke once more. The recesses and protuberances cause a circulation path as shown by the arrows in FIG. 4 to improve scavenging action.

Figure 6:
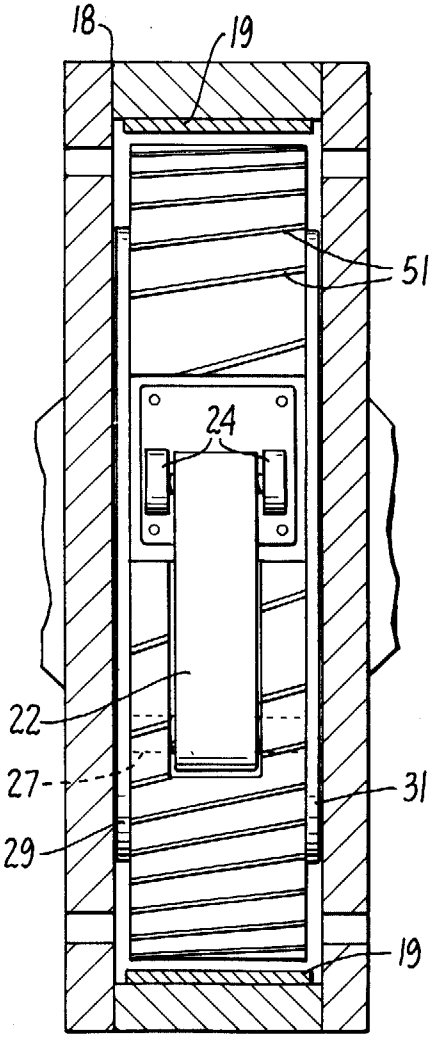
FIG. 6, is a cross-sectional view taken along the plane of line 6—6 of FIG. 1.

The engine here is shown as being cooled by rotor mounted fins 51 which are shown in greater detail in FIGS. 1 and 6. The fins 51 conduct air through suitable apertures 62 in the housing. A suitable shroud or manifold (not shown) is mounted on the back side of the housing to duct the air blown through the housing into an exhaust system (not shown).

Figure 9:
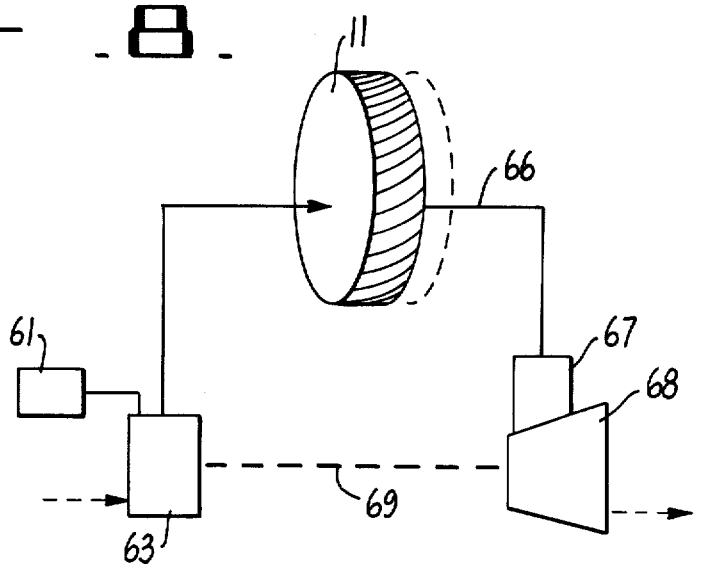
FIG. 9, is a schematic diagram of a carburetion and exhaust system for the engine of the present invention.

In the carburetion and exhaust system shown schematically in FIG. 9, a blower 63 draws air through a carburetor 61 and propels the fuel-air mixture into the chambers for combustion. The exhaust gases are passed through line 66 and vented to a suitable afterburner 67. The mixture of exhaust gases are burned further in the afterburner 67. Energy from such combustion is imparted to a turbine 68 to drive the blower 63 through a suitable coupling 69.

The arcuate shape of the pistons and combustion chambers permit the engine to operate without severe stresses in the piston and rotor materials caused by misalignment of force trying to cock and bend the pistons in the cylinders, and the resulting reduction in friction improves efficiency. The rotor is preferably constructed of aluminum and the pistons are preferably formed of steel. This provides for better cooling of the rotor. The seals may be better placed in the rotor when formed of aluminum, and the pivoted construction of the piston assembly permits the use in the rotor of relatively soft, high heat dissipating metal such as aluminum.

Obviously many modifications and variations of the present invention are possible in the light of the above teachings. For example, the mass of the rotor 11 could be reduced by cutting out portions of the rotor which do not communicate with the combustion chambers 14 and 16, the exhaust ports 32 or the intake port 33. Furthermore, although the preferred embodiment is constructed with two combustion chambers and pistons, the engine may be constructed with any number of combustion chambers to accommodate any desired utilization thereof.

Of course, it will be appreciated that more than one rotor assembly may be mounted on a single shaft with the cylinders of one rotor preferably oriented in angularly spaced relation to the others for multiplying the number of impulses delivered to the shaft.

The rotary engine of the present invention also is suitable for four-cycle mode of operation with relocation of the valve openings. The rotor and swinging piston structure may be adapted for use in a steam or fluid driven engine. It is therefore to be understood that within the scope of the appended claims, the invention may be practiced otherwise than as specifically described.

I claim:

1. In a rotary engine having an oblong inner cam surface, a rotor mountable to rotate within said cam surface and comprising, a body member of axially thickened disk-like shape having a generally cylindrical periphery and flat end faces perpendicular to the axis thereof, a pair of end plates releasably secured to said end faces of said body member, a portion of said body member being cut through from face to face so as to define with said end plates an arcuate combustion chamber of rectangular cross section having parallel curved walls and opening through said periphery, an arcuate piston of rectangular cross section having parallel curved walls and slidable in said arcuate combustion chamber, and a cam follower secured to said piston and extending beyind said periphery into contact with said inner cam surface.

2. In a rotary engine, a rotor as described in claim 1 and wherein straight line seals are mounted in said body member extending through said combustion chamber from said one face to said other face in position for sliding engagement with said piston.

3. In a rotary engine, a rotor as described in claim 1 and wherein said arcuate piston is mounted rigidly on the distal end of a swinging arm pivotally secured to said rotor for guiding said piston in said combustion chamber so as to prevent cocking and twisting of said arcuate piston relative to said arcuate combustion chamber.

4. In a rotary engine, a rotor as described in claim 1 and wherein a portion of the periphery of said body member is relieved to accommodate said arms as said piston makes its deepest penetration into said combustion chamber.

5. In a rotary engine, a rotor as described in claim 1 and wherein said end plates are formed with opposed intake and discharge openings therethrough communicating with said combustion chamber.

6. In a rotary engine, a rotor as described in claim 5 and wherein said intake and discharge openings are formed for communicating with aligned intake and discharge passages in a surrounding housing and are positioned slightly askew from each other so as to communicate said combustion chamber with said discharge passage slightly before communicating said combustion chamber with said intake passage for improving scavenging of exhaust gases from said combustion chamber.

7. In a rotary engine, a rotor as described in claim 5 and wherein said arcuate combustion chamber is formed with a pair of recesses communicating with said intake and discharge openings respectively.

8. In a rotary engine, a rotor as described in claim 7 and wherein said arcuate combustion chamber is formed with a protuberance separating said pair of recesses formed therein.

9. In a rotary engine, a rotor as described in claim 8 and wherein the head end of said arcuate piston remote from said cam follower is formed in mating configuration with the inner end of said combustion chamber.

* * * * *